United States Patent [19]

Derimiggio et al.

[11] Patent Number: 4,984,027

[45] Date of Patent: Jan. 8, 1991

[54] FUSING APPARATUS WITH SOLID ELASTOMERIC FUSER ROLLER

[75] Inventors: John E. Derimiggio, Fairport; Linn C. Hoover, Rochester, both of N.Y.

[73] Assignee: Eastman Kodak Company, Rochester, N.Y.

[21] Appl. No.: 290,799

[22] Filed: Dec. 28, 1988

[51] Int. Cl.[5] ..... G03G 15/20

[52] U.S. Cl. ..... 355/290; 29/130; 219/216; 219/469; 355/285

[58] Field of Search ..... 29/130, 129.5, 132; 219/469, 216, 470, 471; 355/289, 290, 285; 432/60; 430/98, 99; 100/93 RP; 428/906, 447; 101/376

[56] References Cited

U.S. PATENT DOCUMENTS

| | | | |
|---|---|---|---|
| 3,152,387 | 10/1964 | Macleod | 29/129.5 |
| 3,345,937 | 10/1967 | Kusters et al. | 100/93 RP |
| 3,612,820 | 10/1971 | Punnett | 219/470 X |
| 3,849,628 | 11/1974 | Abowitz et al. | 219/471 X |
| 4,309,803 | 1/1982 | Blaszak | 29/130 |
| 4,430,406 | 2/1984 | Newkirk et al. | 29/130 X |
| 4,583,272 | 4/1986 | Keller | 29/132 X |
| 4,810,564 | 3/1989 | Takahashi et al. | 432/60 X |

OTHER PUBLICATIONS

Forward, Xerox Disclosure Journal, vol. 1, No. 3, Mar. 1976.

*Primary Examiner*—A. T. Grimley
*Assistant Examiner*—Robert Beatty
*Attorney, Agent, or Firm*—Tallam I. Nguti

[57] ABSTRACT

A fusing member suitable for use as a fuser roller in an electrostatographic fusing apparatus, is made entirely of elastomeric materials and has a smooth surface that can be heated. Such a fuser roller is particularly inexpensive to manufacture, not susceptible to delamination failure, and particularly suitable for use in a fusing apparatus as an externally heated and axially unsupported roller.

10 Claims, 2 Drawing Sheets

FUSING APPARATUS WITH SOLID ELASTOMERIC FUSER ROLLER

RELATED APPLICATIONS

This application is related to U.S. patent application Ser. No. 290,787, now U.S. Pat. No. 4,905,050 filed on even date on Dec. 28, 1988 in the name of John E. Derimiggio, and entitled "FUSING APPARATUS HAVING AXIALLY UNSUPPORTED ROLLER".

BACKGROUND OF THE INVENTION

This invention relates generally to fusing apparatus in electrostatographic copiers and printers, and more particularly, to a solid elastomeric fusing member that is suitable for use as a fuser roller in such apparatus. The fuser roller of the present invention is particularly inexpensive to manufacture, and particularly suitable for use in a fusing apparatus as an externally heated and axially unsupported fuser roller.

In electrostatographic copiers and printers, conventional heat and pressure fusing apparatus as disclosed, for example, in U.S. Pat. No. 4,551,006, issued Nov. 5, 1985 in the name of Elvin, include a pair of rollers, each having a hollow metallic shell core that may be coated with a layer of elastomeric material. The rollers are axially supported to form a fusing nip through which toner images are conveyed for fusing onto a suitable receiver, or a copy sheet. The heat necessary for such fusing is supplied by a heat source, such as a lamp, located within the hollow of the metallic core of at least the one roller that directly contacts the toner particles forming the image. The heat supplied to the one roller may also be from an external heat source that contacts and directly heats the surface of such roller. Typically, the one roller is the fuser roller, while the other roller is the pressure roller. The pressure necessary for fusing is supplied to the fusing nip through the cooperation of the fuser and pressure rollers.

Such cored and coated rollers, however, are often expensive to manufacture because the metallic shell core must be produced first, and the elastomeric layer or coating added in a different manufacturing step. In addition, bonding between the metallic shell core and the elastomeric layer can be a problem requiring special treatment, and external heating, especially in the case of thinly coated, shell cored rollers, can result in early delamination failure of such rollers.

SUMMARY OF THE INVENTION

It is an object of the present invention to provide a fuser roller that overcomes the limitations and disadvantages associated with cored, coated rollers.

It is a further object of the present invention to provide a fuser roller that is particularly suitable for external heating, and for use, for example, in an axially unsupported configuration in a fusing apparatus.

According to the present invention, a fusing apparatus for fusing toner images to a receiver or copy sheet, through the application of heat and pressure, includes a fuser roller that is comprised entirely of a cylindrical inner portion which is made of a first elastomeric material, and of an annular outer portion which is made of a second elastomeric material overlaying the inner portion.

BRIEF DESCRIPTION OF THE DRAWINGS

In the detailed description of the preferred embodiment of the invention presented below, reference is made to the accompanying drawings in which.

DESCRIPTION OF THE PREFERRED EMBODIMENT

Figure 1:
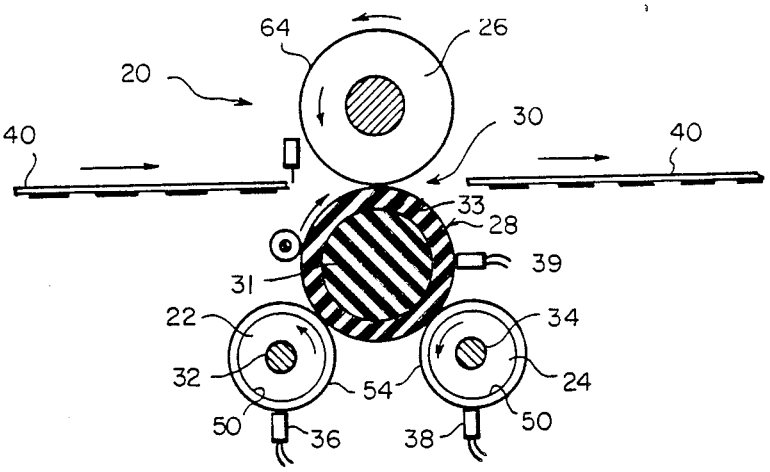
FIG. 1 is a schematic elevational view of a fusing apparatus including the fuser roller of the present invention.

Referring now to FIG. 1, an apparatus suitable for use in fusing toner images, in an electrostatographic copier or printer, is generally designated 20, and includes a pair of heater rollers 22, 24, a pressure roller 26 and a fuser roller 28 that is simply nested in a stacked arrangement between the heater rollers 22, 24, and the pressure roller 26. Nested as such, the fuser roller 28 is in rotational engagement with each of the heater rollers 22, 24 and the pressure roller 26. In addition, fuser roller 28 and pressure roller 26 form a fusing nip 30 through which a copy sheet or receiver 40 carrying unfused toner images can be transported, and the images fused to the receiver.

Figure 2:
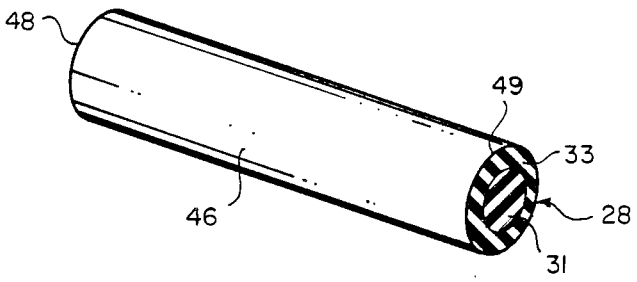
FIG. 2 is a sketch in perspective of the fuser roller of the present invention.

Referring now to FIG. 2, the fuser roller 28, unlike conventional fuser rollers which have metallic shell cores coated with elastomeric materials, is coreless, that is, it is without such a metallic shell core, consisting entirely of a compliant material or materials, such as silicone rubber. As such, fuser roller 28 has no internal cavity, in other words, it is solid. In a preferred embodiment, the fuser roller 28, consists of first and second portion or layers 31, 33 of different types of compliant materials. The first and inner layer 31 may consist of an elastomeric material such as dimethyl polysiloxane RTV, which is strong, but compliant, and which has a low thermal conductivity. On the other hand, the second and outer layer 33 preferably consists of an elastomeric material such as silicone rubber, which is softer than, and has both high toner release properties and high thermal conductivity, relative to the material of the first layer 31. Both layers 31, 33, however, can also be made of the same type of elastomeric material.

Roller 28 is preferable because it is inexpensive to manufacture. For example, desired lengths of the roller 28 can be cut, forming first and second ends 48, 49, from a machine extruded elastomeric roll that has a smooth surface 46 suitable for fusing. As such, the roller 28 is flexible, and has a thick compliant underlayer to the smooth surface 46. Even in the case where layers 31, 33 are made of different elastomeric materials, the two layers can be coextruded in a single step. Made in this manner, roller 28 is capable of forming a large width fusing nip 30 when compressed against the surface 64 of the pressure roller 26. Most importantly, roller 28 when made as such, requires no additional or separate surface coating or lamination of the type that would make it susceptible to early delamination failure.

As pointed out above, in the fusing apparatus 20 of the present invention, roller 28 is merely nested, for example, on heater rollers 22, 24 for support, and for external heating. Rollers 22, 24 are located within the apparatus 20 such that the side-by-side spacing between them should be less than the diameter of the fuser roller 28. As illustrated, each heater roller 22, 24, may consist of a hollow core 50 that has a hard anodized surface coating 54. The core 50 is usually metallic, for example, aluminum. Heat sources 32, 34, which for example may be quartz lamps, are located within each core 50 for internally heating each of the rollers 22, 24. As shown in FIG. 1, the temperatures of rollers 22, 24 when heated, can be sensed and controlled through first and second temperature control sensors 36, 38 respectively, and the temperature of the fuser roller 28 can be sensed and controlled through a third control sensor 39.

Figure 3:
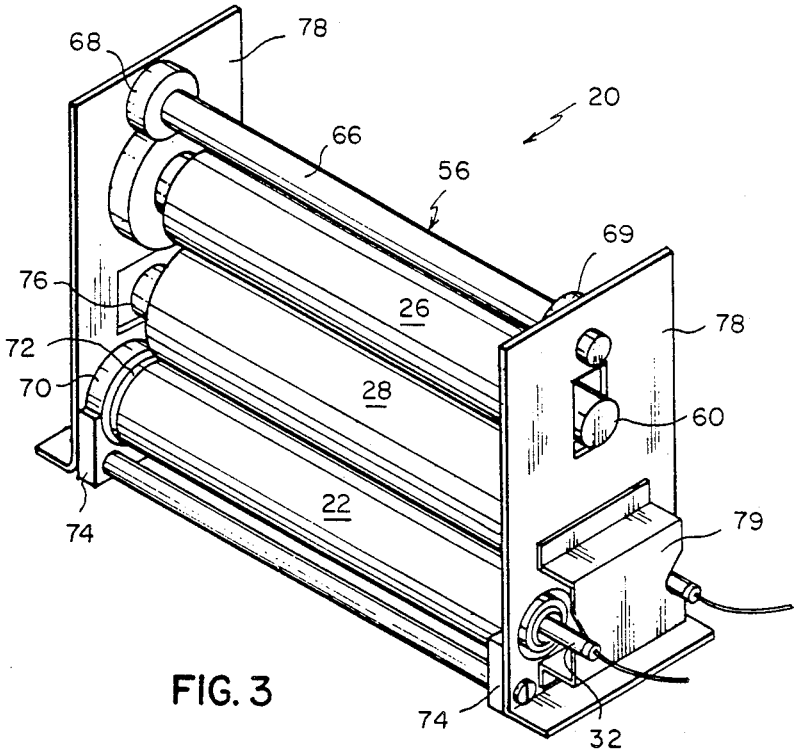
FIG. 3 is a perspective view of the fusing apparatus of FIG. 1.

The pressure roller 26, as illustrated in FIG. 3 includes means, such as a cam assembly 56, that is suitable for urging the pressure roller 26 against the fuser roller 28. For producing one-sided or simplex copies, pressure roller 26 is normally unheated and, therefore, requires no heat source. It may instead include a support shaft 60 located snugly within its core. The cam assembly 56 is connected to drive means (not shown), and is selectively drivable to move the pressure roller 26 against the fuser roller 28. As illustrated, cam assembly 56 may include an elongate shaft 66 and two cam members 68, 69, connected eccentrically at each end. The connections are such that a complete revolution of the cam members is sufficient to move the pressure roller 26 against the fuser roller 28, for applying pressure over the entire length of a copy sheet 40 (FIG. 1) being fed through the fusing nip 30.

As shown in FIG. 3, each heater roller 22, 24 is fitted with a pair of cylindrical end bearings 70. Each bearing 70 has a diameter greater than that of the fuser roller 28, thereby forming a flange 72 at each end of the heater rollers 22, 24. Heater rollers 22, 24 are mounted spaced side by side on a pair of bearing blocks 74 with the bearings 70 being supported directly and for rotation by the blocks 74. The coreless fuser roller 28 is fitted at each end with a preferably conical end cap 76 which can be made of a high temperature plastic. The pressure roller 26 and cam 56 are supported at each end by a support frame 78 that is fastened at its base to the bearing blocks 74. End plates 79 are attached to the frames 78 for supporting the heat sources 32, 34, and for axially maintaining the position of constraining the nested fuser roller 28 through point contact with the end caps 76.

Although fuser roller 28 is without a shell core, and assembled axially unsupported in the apparatus 20, it is substantially free of any tendency to deflect or bend because the stiffness, about it, of the heater and pressure rollers 22, 24, and 26, is equalized. Such bending or deflection of the fuser roller 28 is substantially prevented by selecting the sizes of, and the materials for the rollers, such that the heater rollers 22, 24, and pressure roller 26, have equal and complimentary stiffness or deflectability about the fuser roller 28.

Figure 4:
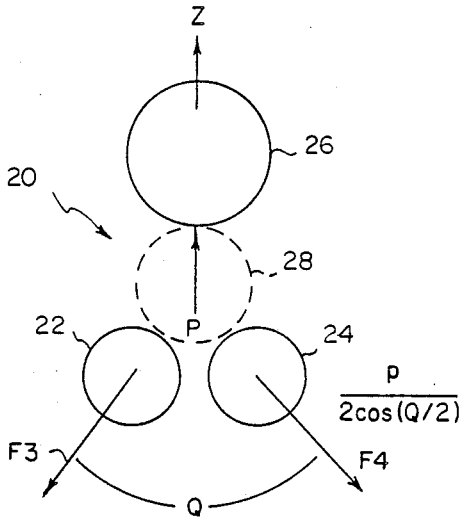
FIG. 4 is schematic of the fusing apparatus of FIG. 1 illustrating forces acting on the rollers.

The stiffness or deflectability of the pressure roller about the fuser roller, for example, can be determined according to the formula $d=CF/E_1I_1$; where $d$=deflection $C$=constant $F$=force applied to the pressure roller $E_1$=Young's modulus of the material of such roller $I_1$=Area moment of inertia of roller Referring now to FIG. 4, a schematic of the fusing apparatus of the present invention is shown in which the heater rollers 22, 24 form an angle Q with the axis of the fuser roller 28. It is assumed that from a pressure roller 26 of given size and material, it is known that such a pressure roller has an area moment of inertia $I_1$, and is made of a material that has a known Young's modulus $E_1$. Furthermore, it is known that a force $F_1$ of magnitude P acts in the Z-direction on the pressure roller 26. As such, forces $F_3$ and $F_4$, each of magnitude $P/2 \cos (Q/2)$ act respectively, as shown, on heater rollers 22, 24. From the above known and given facts, the material for, and size of, the heater rollers 22, 24 can be determined by equating the deflection $CP/E_1I_1$ of the pressure roller 26 in the Z-direction, to the resultant deflection $CP \cos (Q/2)/[2 \cos (Q/2)E_2]$ of the heater rollers, also in the Z-direction, where $E_2$ and $I_2$ represent Young's modulus and area moment of inertia of each heater roller.

Solving the equation $CP/E_1I_1=CP \cos (Q/2)/[2 \cos (Q/2)E_2I_2]$, yields the result $E_1I_1=2E_2I_2$. In other words, in the particular configuration illustrated and preferred for the apparatus 20 of the present invention, $E_2I_2=\frac{1}{2}E_1I_1$. Accordingly therefore, the material and size of each heater roller 22, 24 can then be selected so that this product ratio (of the area moment of inertia and Young's modulus) between the pressure and heater rollers, is satisfied. Doing so will insure that the stiffness of the rollers 22, 24 and 26, about the fuser roller 28, are equalized, for example, in the Z-direction. Equalizing the stiffness of the rollers 22, 24 and 26, as such, should effectively prevent any tendency by the fuser roller 28 to bend any where along its longitudinal axis.

The nested, and axially unsupported stacked arrangement of the fusing apparatus 20 is particularly suitable for the application of the fuser roller of the present invention. In addition, the axially unsupported arrangement advantageously allows the coreless fuser roller 28 to respond freely to fusing related strains and stresses, dissipating such strains and stresses along, and about its longitudinal axis. In particular, the coreless fuser roller 28 is inexpensive to manufacture, and should last longer than conventional shell cored, coated rollers which may be susceptible to early delamination failure.

Although the detailed description of the present invention has been set forth with particular reference to a preferred embodiment, it is understood that variations and modifications can be effected within the scope and spirit of the invention.

We claim:

1. A fuser roller in an electrostatographic copier or printer for use in an apparatus for fusing toner images to a receiver through the application of heat and pressure, the fuser roller consisting entirely of:

(a) a solid cylindrical inner portion having no internal cavity, said inner portion being made of a first elastomeric material; and (b) an annular outer portion made of a second elastomeric material overlaying said cylindrical inner portion said second portion having a smooth surface suitable for contacting the toner images during fusing.

2. The fuser roller of claim 1 wherein said first elastomeric material for said cylindrical inner portion is strong but compliant, and has a low thermal conductivity.

3. The fuser roller of claim 1 wherein said second elastomeric material for said annular outer portion is softer than, and has high toner release properties and substantially higher thermal conductivity than said first elastomeric material.

4. The fuser roller of claim 1 wherein said first and second elastomeric materials are the same.

5. The fuser roller of claim 2 or 4 wherein said first elastomeric material is a dimethyl polysiloxane RTV.

6. The fuser roller of claim 3 or 4 wherein said second elastomeric material is silicone rubber.

7. An electrostatographic copier or printer having an apparatus for fusing toner images to a receiver through the application of heat and pressure, the apparatus including:

(a) a fuser roller consisting entirely of (i) a solid cylindrical inner portion having no internal cavity, said inner portion being made of a first elastomeric material, and of (ii) an annular outer portion made of a second elastomeric material said second portion having a smooth surface suitable for contacting the toner images during fusing;

(b) a pressure roller forming a fusing nip with said fuser roller; and (c) means for heating said fuser roller to a suitable fusing temperature.

8. The apparatus of claim 7 wherein said heating means consists of a pair of heater rollers for externally heating said fuser roller.

9. The apparatus of claim 8 wherein said fuser roller is simply nested, axially unsupported on said heater rollers below said pressure roller in a stacked arrangement.

10. The apparatus of claim 9 wherein the stiffness of said heater rollers is equal to the stiffness of said pressure roller, about said fuser roller.

* * * * *